US009333137B1

(12) United States Patent
Hernandez et al.

(10) Patent No.: US 9,333,137 B1
(45) Date of Patent: May 10, 2016

(54) PATIENT POSITIONING DEVICE

(71) Applicants: Henry Hernandez, Hialeah, FL (US); Maray Guerra, Hialeah, FL (US); Hector Guerra, Hialeah, FL (US); Olga De Armas, Hialeah, FL (US)

(72) Inventors: Henry Hernandez, Hialeah, FL (US); Maray Guerra, Hialeah, FL (US); Hector Guerra, Hialeah, FL (US); Olga De Armas, Hialeah, FL (US)

( * ) Notice: Subject to any disclaimer, the term of this patent is extended or adjusted under 35 U.S.C. 154(b) by 0 days.

(21) Appl. No.: 14/209,130

(22) Filed: Mar. 13, 2014

(51) Int. Cl.
*A61G 7/07* (2006.01)

(52) U.S. Cl.
CPC ..... *A61G 7/07* (2013.01)

(58) Field of Classification Search
CPC .... A47C 20/027; A47C 20/021; A47C 20/23; A47C 20/08; A47C 20/10; A47C 20/12; A47C 21/08; A61G 13/101; A61G 13/12; A61G 13/122; A61G 13/1225; A61G 7/07; A61B 6/04; A61B 6/0407; A61B 6/0414; A61B 6/0421
See application file for complete search history.

(56) References Cited

U.S. PATENT DOCUMENTS

| | | | | | |
|---|---|---|---|---|---|
| 627,663 | A * | 6/1899 | Walden | 5/633 |
| 775,482 | A * | 11/1904 | White | 5/634 |
| 1,067,733 | A * | 7/1913 | Hassel | 5/651 |
| 3,669,118 | A * | 6/1972 | Colon-Morales | 606/121 |
| 4,180,879 | A * | 1/1980 | Mann | 5/658 |
| 4,249,712 | A * | 2/1981 | DeLong | 248/118 |
| 4,328,799 | A * | 5/1982 | LoPiano | 604/23 |
| 4,655,207 | A * | 4/1987 | Ellis | 128/871 |
| 5,390,383 | A * | 2/1995 | Carn | 5/624 |
| 5,575,027 | A * | 11/1996 | Mueller | 5/621 |
| 6,032,309 | A * | 3/2000 | Michelson | 5/621 |
| 6,142,699 | A * | 11/2000 | Pao | 403/109.5 |
| 6,305,869 | B1 * | 10/2001 | Chen | 403/109.5 |
| 6,374,440 | B1 * | 4/2002 | Thim, Jr. | 5/633 |
| 6,820,621 | B2 * | 11/2004 | DeMayo | 128/845 |
| 6,934,987 | B2 | 8/2005 | Newkirk et al. | |
| 6,941,951 | B2 * | 9/2005 | Hubert et al. | 128/845 |
| 7,007,330 | B2 | 3/2006 | Kuiper et al. | |
| 7,080,422 | B2 | 7/2006 | Ben-Levi | |
| 7,716,758 | B2 | 5/2010 | De Kruijf | |
| 8,051,515 | B1 * | 11/2011 | Kring | 5/658 |
| 8,099,808 | B1 * | 1/2012 | McKeon | 5/624 |
| 8,118,029 | B2 * | 2/2012 | Gneiting et al. | 128/845 |
| 8,151,388 | B2 | 4/2012 | West, III | |
| 8,286,283 | B2 | 10/2012 | Copeland et al. | |
| 8,621,692 | B1 * | 1/2014 | Kring | 5/658 |
| 8,782,832 | B2 * | 7/2014 | Blyakher et al. | 5/601 |
| 2002/0157186 | A1 * | 10/2002 | VanSteenburg et al. | 5/621 |
| 2003/0216781 | A1 * | 11/2003 | Cuccia | 606/237 |
| 2004/0123392 | A1 * | 7/2004 | Stewart et al. | 5/632 |
| 2006/0248650 | A1 * | 11/2006 | Skripps | 5/621 |
| 2007/0089239 | A1 | 4/2007 | Whiteside | |
| 2008/0034502 | A1 * | 2/2008 | Copeland et al. | 5/621 |
| 2008/0078031 | A1 * | 4/2008 | Weinstein et al. | 5/630 |
| 2009/0044813 | A1 * | 2/2009 | Gneiting et al. | 128/845 |
| 2011/0170671 | A1 * | 7/2011 | Blyakher et al. | 378/209 |
| 2012/0102652 | A1 * | 5/2012 | Summers | 5/630 |
| 2012/0186012 | A1 | 7/2012 | Ponsi et al. | |
| 2013/0097781 | A1 * | 4/2013 | Thomas | 5/601 |
| 2014/0059773 | A1 * | 3/2014 | Carn | 5/624 |

* cited by examiner

*Primary Examiner* — David E Sosnowski
*Assistant Examiner* — Eric Kurilla

(57) ABSTRACT

A patient positioning device attaches to a bed rail to stabilize a patient on the patient's side to more easily provide care to the patient. The device includes a shaft having a first end and a second end. A cushion is coupled to the first end of the shaft. The cushion is configured for abutting a back side of a patient to support the back side of the patient. A tube is coupled to the second end of the shaft. A plurality of clips is coupled to the tube The clips are configured for releasably attaching to a bed rail.

12 Claims, 4 Drawing Sheets

PATIENT POSITIONING DEVICE

BACKGROUND OF THE DISCLOSURE

Field of the Disclosure

The disclosure relates to positioning devices and more particularly pertains to a new positioning device for attaching to a bed rail to stabilize a patient on the patient's side to more easily provide care to the patient.

SUMMARY OF THE DISCLOSURE

An embodiment of the disclosure meets the needs presented above by generally comprising a shaft having a first end and a second end. A cushion is coupled to the first end of the shaft. The cushion is configured for abutting a back side of a patient to support the back side of the patient. A tube is coupled to the second end of the shaft. A plurality of clips is coupled to the tube The clips are configured for releasably attaching to a bed rail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
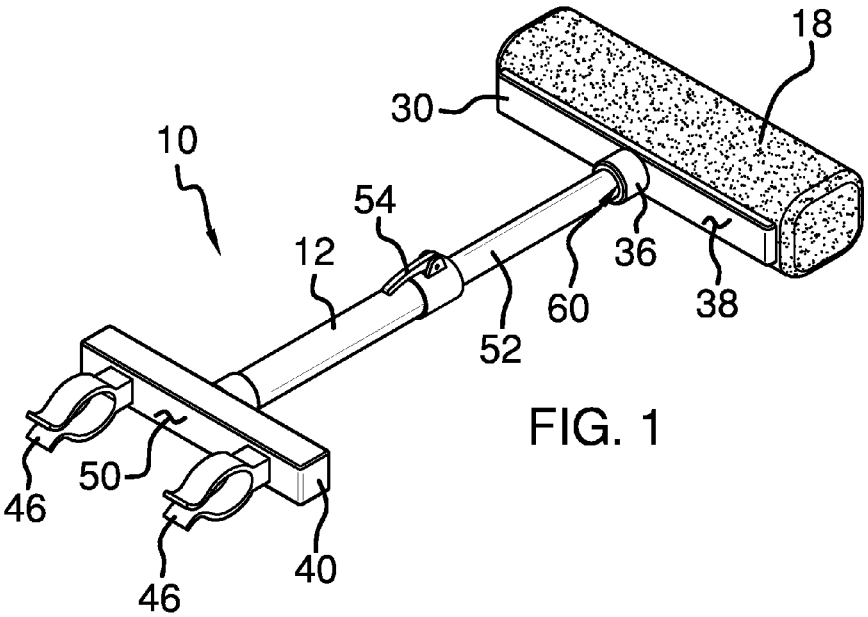
FIG. 1 is a top rear side perspective view of a patient positioning device according to an embodiment of the disclosure.
Figure 2:
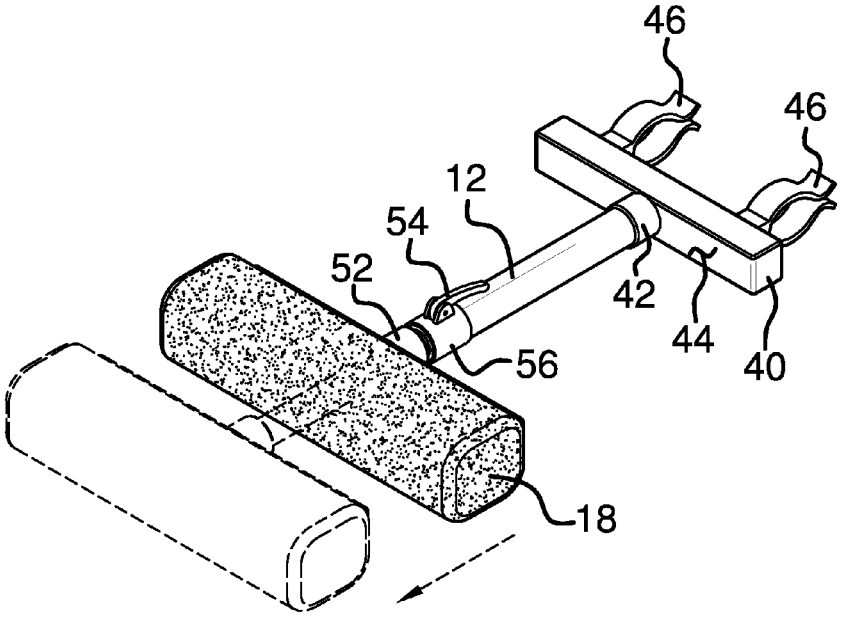
FIG. 2 is a top front side perspective view of an embodiment of the disclosure.
Figure 3:
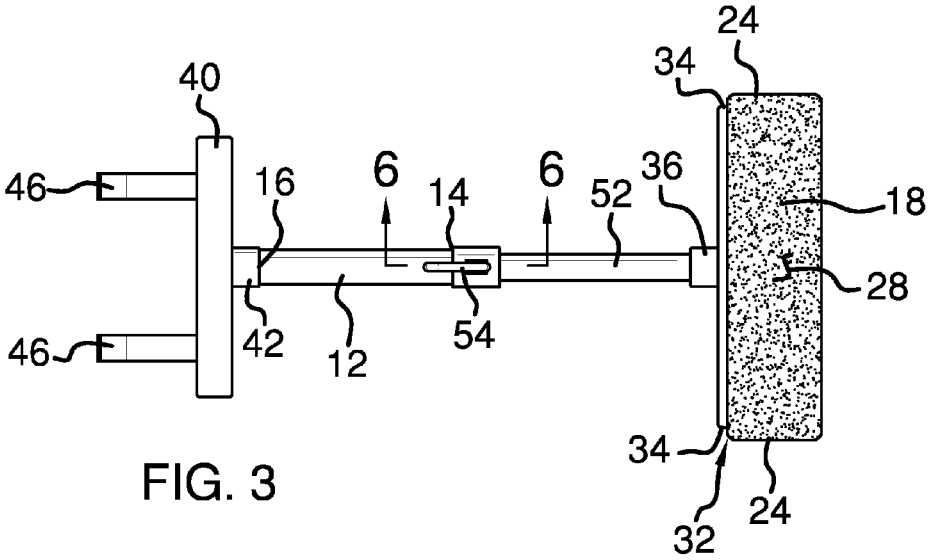
FIG. 3 is a top view of an embodiment of the disclosure.
Figure 4:
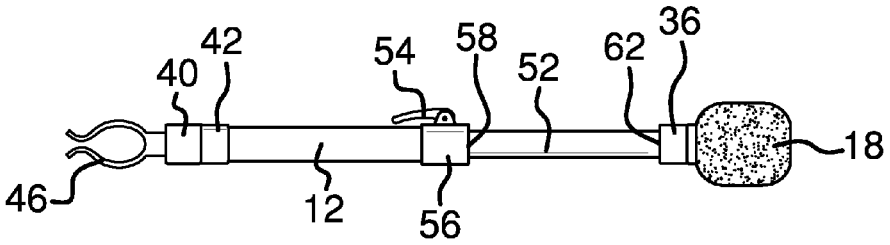
FIG. 4 is a side view of an embodiment of the disclosure.
Figure 5:
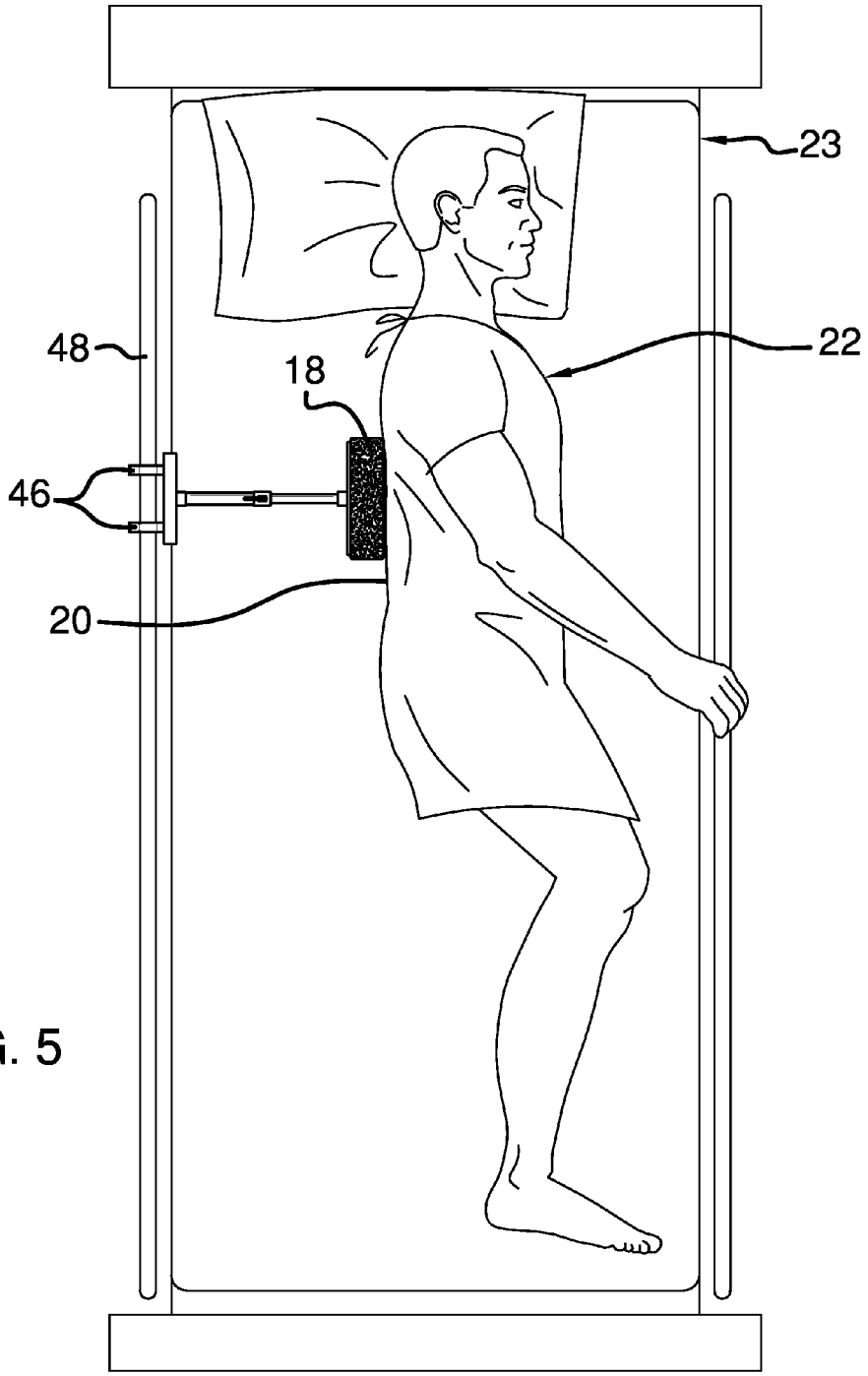
FIG. 5 is a top view of an embodiment of the disclosure in use.
Figure 6:
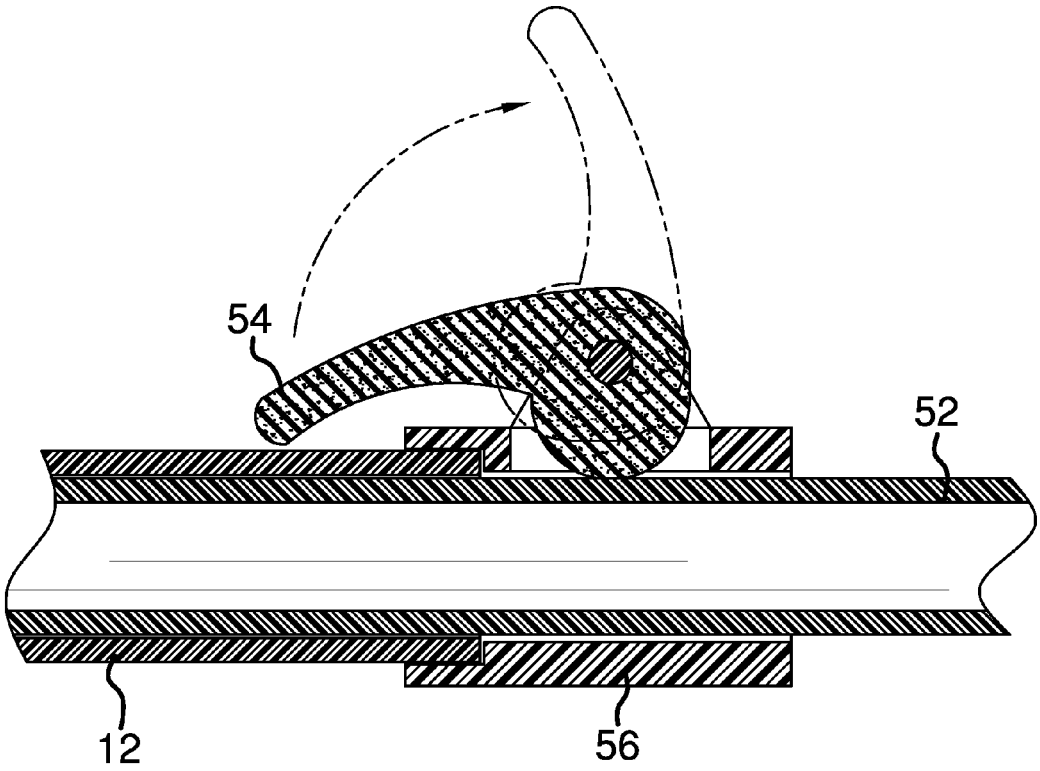
FIG. 6 is a cross-sectional view of an embodiment of the disclosure taken along line 6-6 of FIG. 3.

With reference now to the drawings, and in particular to FIGS. 1 through 5 thereof, a new positioning device embodying the principles and concepts of an embodiment of the disclosure and generally designated by the reference numeral 10 will be described.

As best illustrated in FIGS. 1 through 5, the patient positioning device 10 generally comprises a shaft 12 having a first end 14 and a second end 16. A longitudinal axis extends along the shaft 12 between the first end 14 and the second end 16 of the shaft 12. The device 10 may have a length between approximately 75.0 centimeters and 110.0 centimeters. The device 10 may be constructed from metal, plastic or like material.

A cushion 18 is coupled to the first end 14 of the shaft 12. The cushion 18 is configured for abutting a back side 20 of a patient 22 to support the back side 20 of the patient 22 while the patient is lying in a bed 23. This allows the patient 22 to be positioned on and stabilized on his or her side. The cushion 18 may comprise a foam material 28 or the like. The cushion 18 is positioned transversely relative to the longitudinal axis of the shaft 12. The cushion 18 is elongated. Lateral sides 24 of the cushion 18 may have rounded edges 26. The lateral sides 24 of the cushion 18 may be substantially square-shaped. A plate 30 is coupled to a bottom surface 32 of the cushion 18. Each of the lateral sides 24 of the cushion 18 extends outwardly beyond an associated lateral side 34 of the plate 30. This prevents the plate 30 from contacting the back side of the patient 22 when the cushion 18 abuts the back side 20 of the patient 22. A connector 36 is coupled to a rear side 38 of the plate 30.

A tube 40 is coupled to the second end 16 of the shaft 12. The tube 40 is positioned transversely relative to the longitudinal axis of the shaft 12. A coupler 42 attaches a front side 44 of the tube 40 to the second end 16 of the shaft 12. A plurality of clips 46 is coupled to the tube 40. The clips 46 are configured for releasably attaching to a bed rail 48. The clips 46 are coupled to and extend outwardly from a rear side 50 of the tube 40.

An extension rod 52 is coupled to the first end 14 of the shaft 12. The extension rod 52 is positionable between the shaft 12 and the cushion 18. In particular, the extension rod 52 is slidably positioned within an interior of the shaft 12. A lock 54 selectively secures the extension rod 52 to the shaft 12 at a selectable length relative to the shaft 12 to permit adjustment of a length of the device 10. A collar 56 is positioned on and extends around the first end 14 of the shaft 12 and a second end 58 of the extension rod 52. The lock 54 is coupled to the collar 56. An aperture 60 is positioned in the connector 36 wherein a first end 62 of the extension rod 52 is positioned within the aperture 60.

In use, as stated above and shown in the Figures, the clips 46 are attached to the bed rail 48 of a bed 23. The extension rod 52 is slid relative to the shaft 12 to adjust a length of the device 10. A patient 22 lying in the bed 23 is positioned on his or her side through the assistance of another person. The cushion 18 is positioned so that it abuts the back side 20 of the patient 22 to stabilize the patient 22 on his or her side. In this manner, the device 10 allows a single person to provide care to the patient 22, such as changing clothes of the patient 22 or providing a bath to the patient 22 while the patient 22 is lying in the bed 23. If necessary, the patient 22 is turned over to the opposite side to repeat the process for the opposite side. For example, if the device 10 is being used to bathe the patient 22 on the bed 23, flipping the patient 22 to the opposite side will be necessary to provide a through cleaning of the patient's body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A patient positioning device comprising:

a shaft having a first end and a second end;

a cushion being coupled to said first end of said shaft, said cushion being configured for abutting a back side of a patient to support the back side of the patient;

a tube being coupled to said second end of said shaft;

a plurality of clips being coupled to said tube, said clips being configured for releasably attaching to a bed rail, said clips being coupled to and extending outwardly from a rear side of said tube coplanar with said shaft and said tube and parallel to a longitudinal axis of said shaft wherein said clips are configured for engaging a bed rail such that said shaft is configured to extend perpendicularly from the bed rail;

an extension rod being coupled to said first end of said shaft, said extension rod being positionable between said shaft and said cushion, said extension rod being slidably positioned within an interior of said shaft;

a lock selectively securing said extension rod to said shaft at a selectable length relative to said shaft to permit adjustment of a length of said device;

a collar positioned on and extending around said first end of said shaft and a second end of said extension rod; and said lock being coupled to said collar.

2. The device of claim 1, further comprising:

a longitudinal axis extending along said shaft between said first end and said second end of said shaft; and said tube being positioned transversely relative to said longitudinal axis of said shaft.

3. The device of claim 1, further comprising said cushion being positioned transversely relative to said longitudinal axis of said shaft.

4. The device of claim 1, further comprising said cushion being elongated.

5. The device of claim 1, further comprising a plate coupled to a bottom surface of said cushion.

6. The device of claim 5, further comprising:

an extension rod being coupled to said first end of said shaft, said extension rod being positionable between said shaft and said cushion;

a connector coupled to a rear side of said plate; and an aperture positioned in said connector wherein a first end of said extension rod is positioned within said aperture.

7. The device of claim 1, further comprising a coupler attaching a front side of said tube to said second end of said shaft.

8. The device of claim 5, further comprising each of a pair of lateral sides of said cushion extending outwardly beyond an associated lateral side of said plate.

9. The device of claim 1, further comprising lateral sides of said cushion having rounded edges.

10. The device of claim 9, further comprising lateral sides of said cushion being substantially square-shaped.

11. The device of claim 1, wherein said cushion comprises a foam material.

12. A patient positioning device comprising:

a shaft having a first end and a second end, a longitudinal axis extending along said shaft between said first end and said second end of said shaft;

a cushion being coupled to said first end of said shaft, said cushion being configured for abutting a back side of a patient to support the back side of the patient, said cushion being positioned perpendicularly relative to said longitudinal axis of said shaft, said cushion being elongated, lateral sides of said cushion having rounded edges, said lateral sides of said cushion being substantially square-shaped, said cushion comprising a foam material;

a plate coupled to a bottom surface of said cushion, each of said lateral sides of said cushion extending outwardly beyond an associated lateral side of said plate;

a tube being coupled to said second end of said shaft, said tube being positioned transversely relative to said longitudinal axis of said shaft;

a coupler attaching a front side of said tube to said second end of said shaft;

a plurality of clips being coupled to said tube, said clips being configured for releasably attaching to a bed rail, said clips being coupled to and extending outwardly from a rear side of said tube coplanar with said shaft and said tube and parallel to a longitudinal axis of said shaft wherein said clips are configured for engaging a bed rail such that said shaft is configured to extend perpendicularly from the bed rail;

an extension rod being coupled to said first end of said shaft, said extension rod being positionable between said shaft and said cushion, said extension rod being slidably positioned within an interior of said shaft;

a lock selectively securing said extension rod to said shaft at a selectable length relative to said shaft to permit adjustment of a length of said device;

a collar positioned on and extending around said first end of said shaft and a second end of said extension rod, said lock being coupled to said collar;

a connector coupled to a rear side of said plate; and an aperture positioned in said connector wherein a first end of said extension rod is positioned within said aperture.

* * * * *